US010508627B2

(12) United States Patent
Kim et al.

(10) Patent No.: US 10,508,627 B2
(45) Date of Patent: Dec. 17, 2019

(54) ANTI-ICING DEVICE FOR INTAKE MANIFOLD

(71) Applicant: HYUNDAI KEFICO CORPORATION, Gunpo, Gyeonggi-do (KR)

(72) Inventors: Min Ki Kim, Gyeonggi-do (KR); Hyung Wook Kim, Gyeonggi-do (KR); Chan Karam Na, Seoul (KR)

(73) Assignee: HYUNDAI KEFICO CORPORATION, Gunpo, Gyeonggi-do (KR)

( * ) Notice: Subject to any disclaimer, the term of this patent is extended or adjusted under 35 U.S.C. 154(b) by 0 days.

(21) Appl. No.: 16/029,105

(22) Filed: Jul. 6, 2018

(65) Prior Publication Data

US 2019/0032611 A1 Jan. 31, 2019

(30) Foreign Application Priority Data

Jul. 28, 2017 (KR) ..... 10-2017-0096153

(51) Int. Cl.

| | |
|---|---|
| ***F02M 35/10*** | (2006.01) |
| ***F01M 13/00*** | (2006.01) |
| ***F02M 35/112*** | (2006.01) |
| ***F01M 13/04*** | (2006.01) |

(52) U.S. Cl.

CPC ..... *F02M 35/10222* (2013.01); *F01M 13/00* (2013.01); *F02M 35/112* (2013.01); *F01M 13/04* (2013.01); *F01M 2013/0038* (2013.01); *F01M 2013/0455* (2013.01)

(58) Field of Classification Search

CPC ..... F02M 35/10222; F02M 35/112; F01M 13/04; F01M 13/00; F01M 2013/0455; F01M 2013/0038

See application file for complete search history.

(56) References Cited

U.S. PATENT DOCUMENTS

| | | | | |
|---|---|---|---|---|
| 2006/0005820 | A1* | 1/2006 | Jeon | F02M 35/10039 123/572 |
| 2008/0314351 | A1 | 12/2008 | Ryrholm et al. | |
| 2012/0132158 | A1 | 5/2012 | Park | |
| 2012/0138030 | A1* | 6/2012 | Yang | F01M 13/022 123/574 |

(Continued)

FOREIGN PATENT DOCUMENTS

| | | | |
|---|---|---|---|
| DE | 102004043545 | A1 | 3/2006 |
| JP | 2012215137 | A | 11/2012 |

(Continued)

*Primary Examiner* — Jacob M Amick
*Assistant Examiner* — Charles Brauch
(74) *Attorney, Agent, or Firm* — Mintz Levin Cohn Ferris Glovsky and Popeo, P.C.; Jhongwoo Peck

(57) ABSTRACT

The present disclosure relates to an anti-icing device for an intake manifold for preventing freezing of a blow-by gas flowing from a crankcase of an engine into a plenum chamber of an intake manifold through a gas inlet, and includes a guide member provided inside the plenum chamber, and for inducing the blow-by gas discharged from the gas inlet toward the inside of the plenum chamber that is away from the fresh air inlet, and an engaging means for fixing the guide member to the intake manifold, thus preventing the freezing from occurring and the inlet from clogging by the freezing.

13 Claims, 17 Drawing Sheets

(56) References Cited

U.S. PATENT DOCUMENTS

2017/0082074 A1* 3/2017 Kim ..... F01M 13/0011

FOREIGN PATENT DOCUMENTS

| | | | | |
|---|---|---|---|---|
| KR | 2003013597 | A | * | 2/2003 |
| KR | 100412568 | B1 | | 12/2003 |
| KR | 10-2005-0108562 | A | | 11/2005 |
| KR | 10-1234649 | B1 | | 2/2013 |
| RU | 2013142182 | A | | 3/2015 |

* cited by examiner (Related Art)

ANTI-ICING DEVICE FOR INTAKE MANIFOLD

CROSS-REFERENCE(S) TO RELATED APPLICATIONS

This application claims priority to Korean Patent Application No. 10-2017-0096153, filed on Jul. 28, 2017, the disclosure of which is incorporated herein by reference in its entirety.

TECHNICAL FIELD

The present disclosure relates to an anti-icing device for an intake manifold, and more particularly, to an anti-icing device for an intake manifold, which can prevent a gas inlet from being clogged because a blow-by gas exited from a crankcase of an engine and flowed into a plenum chamber of an intake manifold through the gas inlet is frozen.

RELATED ART

Generally, an intake manifold uniformly supplies the mixture formed in a vaporizer to a combustion chamber. The intake manifold typically includes a plenum chamber for temporarily storing the supplied mixture, a throttle body attached to communicate to one side of the plenum chamber to flow the mixture through the vaporizer, and an intake runner for guiding so that the mixture stored in the plenum chamber flows to each combustion chamber.

An unburned exhaust gas exited (e.g., leaking) from the combustion chamber into a crankcase through a gap between a cylinder and a piston during the compression stroke and the expansion stroke of the mixture supplied to each combustion chamber through the intake runner is referred to as a blow-by gas, and the blow-by gas exits from the combustion chamber into the crankcase, then passes through the exhaust passage of a cylinder block and a cylinder head, and a head cover through a Positive Crankcase Ventilation (PCV) system, and is recirculated through a separate PCV hose to the intake manifold.

Referring to FIG. 1, in the conventional intake manifold 1, a PCV hose (not illustrated) is connected to a PCV nipple 11, and the blow-by gas flows into a gas inlet 12 through the PCV nipple 11, and the blow-by gas supplied to the gas inlet 12 is discharged to a plenum chamber 13 and then mixed with a mixture (fresh air) newly supplied through a fresh air inlet 14 to be distributed to each intake runner.

However, under cold weather conditions, the moisture in the blow-by gas supplied into the intake manifold 1 freezes due to a temperature difference with the outside air, thus clogging the flow path. There has been a problem in that as the blow-by gas interacts with the fresh air supplied through the fresh air inlet 14 near the gas inlet 12, freezing is caused by the temperature difference with the cold fresh air, such that the gas inlet 12 is narrowed or clogged.

The above information disclosed in this section is merely for enhancement of understanding of the background of the disclosure and therefore it may contain information that does not form the prior art that is already known in this country to a person of ordinary skill in the art.

SUMMARY

An object of the present disclosure is to provide an anti-icing device for an intake manifold, which can prevent the blow-by gas from freezing at the gas inlet and to prevent the gas inlet from being clogged by the freezing.

An anti-icing device for an intake manifold in accordance with an embodiment of the present disclosure for achieving the object is provided as an anti-icing device for an intake manifold to prevent a problem in which a blow-by gas flowing from a crankcase of an engine into a plenum chamber of an intake manifold through a gas inlet via a Positive Crankcase Ventilation (PCV) nipple is frozen due to a temperature difference with a fresh air supplied into the plenum chamber through a fresh air inlet. The anti-icing device for an intake manifold may include a guide member disposed within the plenum chamber, and for inducing the blow-by gas discharged from the gas inlet toward the inside of the plenum chamber in a direction that is away from the fresh air inlet in order to retard a contact with the fresh air.

In this case, the anti-icing device for the intake manifold in accordance with the present disclosure may further include an engaging means for fixing the guide member to the intake manifold.

Meanwhile, the guide member may include a guide for inducing a discharging direction of the blow-by gas discharged from the gas inlet to the direction that is away from the fresh air inlet.

Further, the anti-icing device for the intake manifold in accordance with the present disclosure may include a thermal insulation material for blocking heat transfer of the fresh air outside the guide.

Meanwhile, the guide may include a first guide panel for diverting the discharging direction of the blow-by gas discharged from the gas inlet; and a second guide panel spaced apart from the first guide panel, and for guiding an inflow of the fresh air to the plenum chamber to obstruct a stream of the fresh air through the fresh air inlet from contacting the blow-by gas. In this case, the second guide panel may be spaced apart from the first guide panel to an outer side that is opposite of an inner side that faces the discharged blow-by gas, and formed to extend farther from the fresh air inlet than the first guide panel.

Further, a thermal insulation material may be disposed between the first guide panel and the second guide panel.

In addition, the guide member may further include a base plate formed substantially perpendicular to the guide and formed to abut an inside wall of the plenum chamber, and for blocking the blow-by gas discharged from the gas inlet to disperse downward from the plenum chamber. On the other hand, the guide member may have an open side on an opposite side of the base plate. Further, the anti-icing device for the intake manifold in accordance with the present disclosure may include a drain aperture formed on the base plate.

The engaging means may include an engaging boss portion integrally injection-molded with the guide member, and a boss receiving portion provided in the intake manifold, and the engaging boss portion and the boss receiving portion may be engaged with each other.

In particular, the boss receiving portion may be provided in an engaging portion in which a lower shell and a middle shell of the intake manifold may be superposed with each other, and the lower shell and the middle shell may be configured to be superposed and assembled with the engaging boss portion fitted in the boss receiving portion. The engaging boss portion may be configured to be fitted in the boss receiving portion in a direction in which the lower shell and the middle shell are coupled.

Meanwhile, the first guide panel and the second guide panel may be integrally molded and formed with one of the shells of the intake manifold.

In addition, the PCV nipple may be formed separately to be coupled on the intake manifold and may have an inclined gas flow path toward the gas inlet, and a protrusion may be formed on an outer circumferential surface of an end portion thereof toward the gas inlet side.

As described above, the anti-icing device for the intake manifold in accordance with the present disclosure may move the location where the blow-by gas and the fresh air are mixed to the more downstream direction of the intake manifold and may move the location where the ice crystals are formed, thus preventing the freezing from occurring at the gas inlet and clogging the gas inlet.

DETAILED DESCRIPTION

Figure 1:
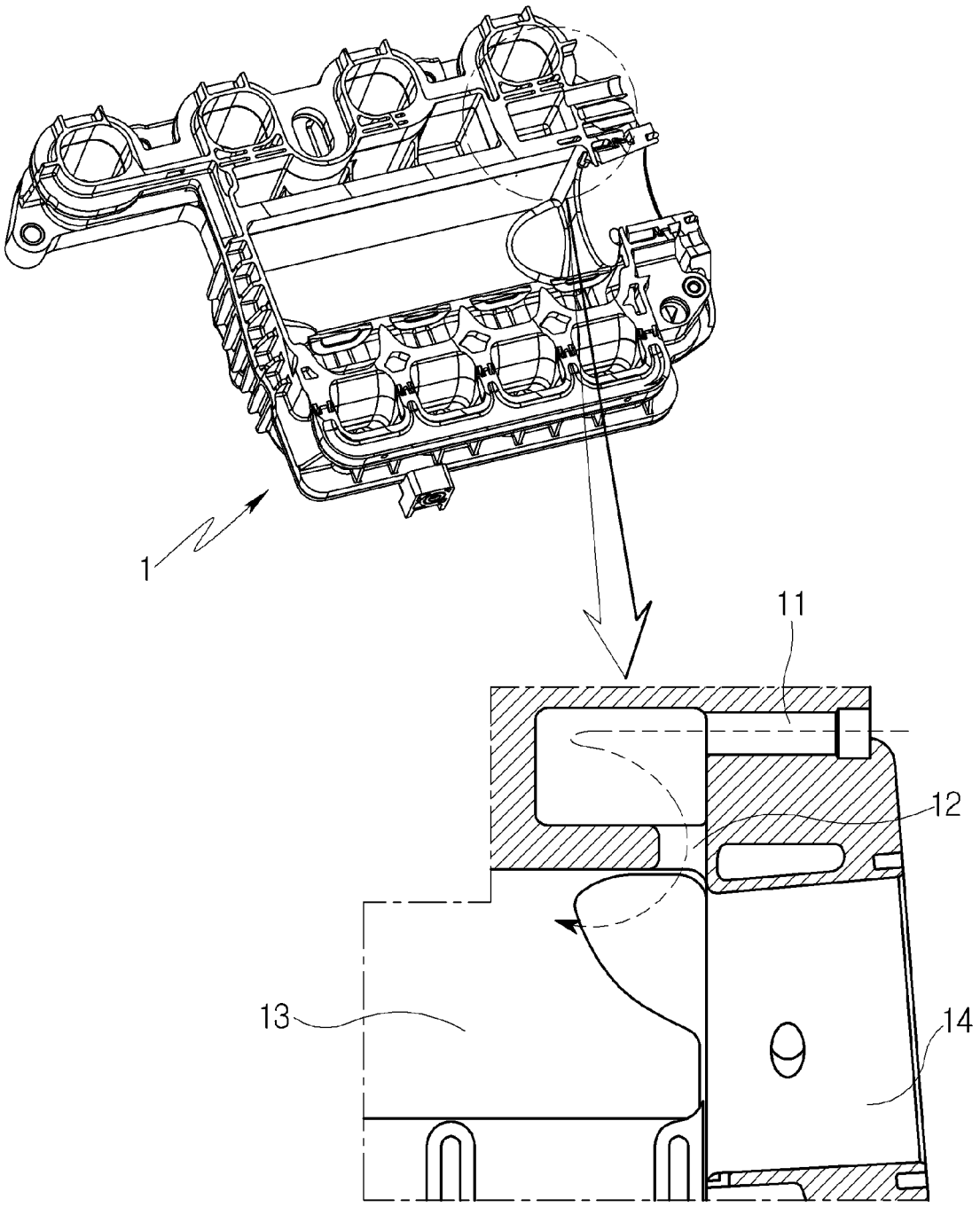
FIG. 1 is a perspective diagram illustrating an anti-icing device for an intake manifold in accordance with the related art.

Advantages and features of the present disclosure and a method of achieving the same will become apparent with reference to the attached drawings and embodiments described below in detail. However, the present disclosure is not limited to the embodiments described below and may be embodied with a variety of different modifications. The embodiments are merely provided to allow one of ordinary skill in the art to completely understand the scope of the present disclosure and are defined by the scope of the claims. Throughout the specification, like reference numerals refer to like elements.

Accordingly, in some embodiments, well-known operations of a process, well-known structures, and well-known technologies will be not described in detail to avoid obscuring understanding of the present disclosure.

The terms used herein are for explaining embodiments but are not intended to limit the present disclosure. Throughout the specification, unless particularly defined otherwise, singular forms include plural forms. The terms "comprises" and/or "comprising" are used herein as meanings which do not exclude presence or addition of one or more other components, stages, and/or operations in addition to stated components, stages, and/or operations. Also, "and/or" includes each and one or more combinations of stated items.

Also, embodiments disclosed herein will be described with reference to perspective views, cross-sectional views, side views, and/or schematic diagrams which are exemplary views of the present disclosure. Accordingly, modifications may be made in the forms of exemplary views by manufacturing technology, allowable error, and/or the like. Accordingly, the embodiments of the present disclosure will not be limited to particular forms shown in the drawings and include changes made by a manufacturing process. Also, throughout the drawings of the present disclosure, components may be slightly exaggerated or reduced in consideration of convenience of description.

Hereinafter, preferred embodiments of the present disclosure will be described in detail with reference to the accompanying drawings.

Referring to FIGS. 2 to 12, an anti-icing device for an intake manifold in accordance with an exemplary embodiment of the present disclosure is provided as the anti-icing device for the intake manifold to address a situation in which a blow-by gas exited (e.g. leaking) from a crankcase of an engine and entering a plenum chamber 120 of an intake manifold 100 through a gas inlet 142 via a Positive Crankcase Ventilation (PCV) nipple 141 is frozen due to a temperature difference with a fresh air supplied into the plenum chamber 120 through a fresh air inlet 130. The anti-icing device may include a guide member 200 disposed inside the plenum chamber 120, and for inducing the blow-by gas discharged from the gas inlet 142 toward the inside of the plenum chamber 120 that is away from the fresh air inlet 130 in order to retard the contact with the fresh air. In this case, the anti-icing device for the intake manifold in accordance with the exemplary embodiment of the present disclosure may further include an engaging means 300 for fixing the guide member 200 to the intake manifold 100.

The intake manifold 100 is provided with the plenum chamber 120 for storing a fresh air supplied through a vaporizer and a throttle body and supplying it to a plurality of intake runners. The fresh air supplied from the vaporizer flows into the plenum chamber 120 through the fresh air inlet 130, and the blow-by gas flows into the plenum chamber 120 through the gas inlet 142.

Figure 2:
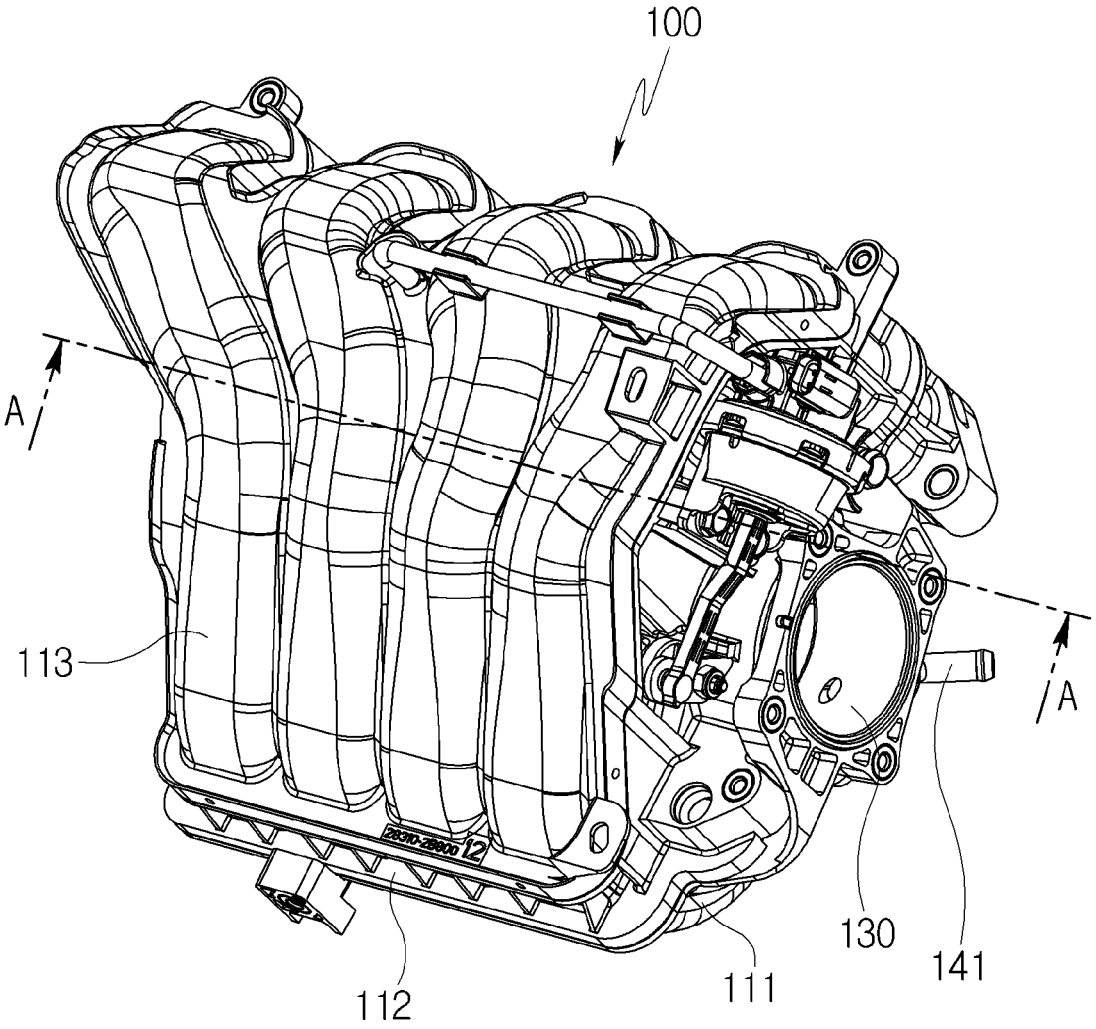
FIG. 2 is an engaged perspective diagram illustrating an intake manifold in which an anti-icing device is mounted in accordance with an exemplary embodiment of the present disclosure.
Figure 3:
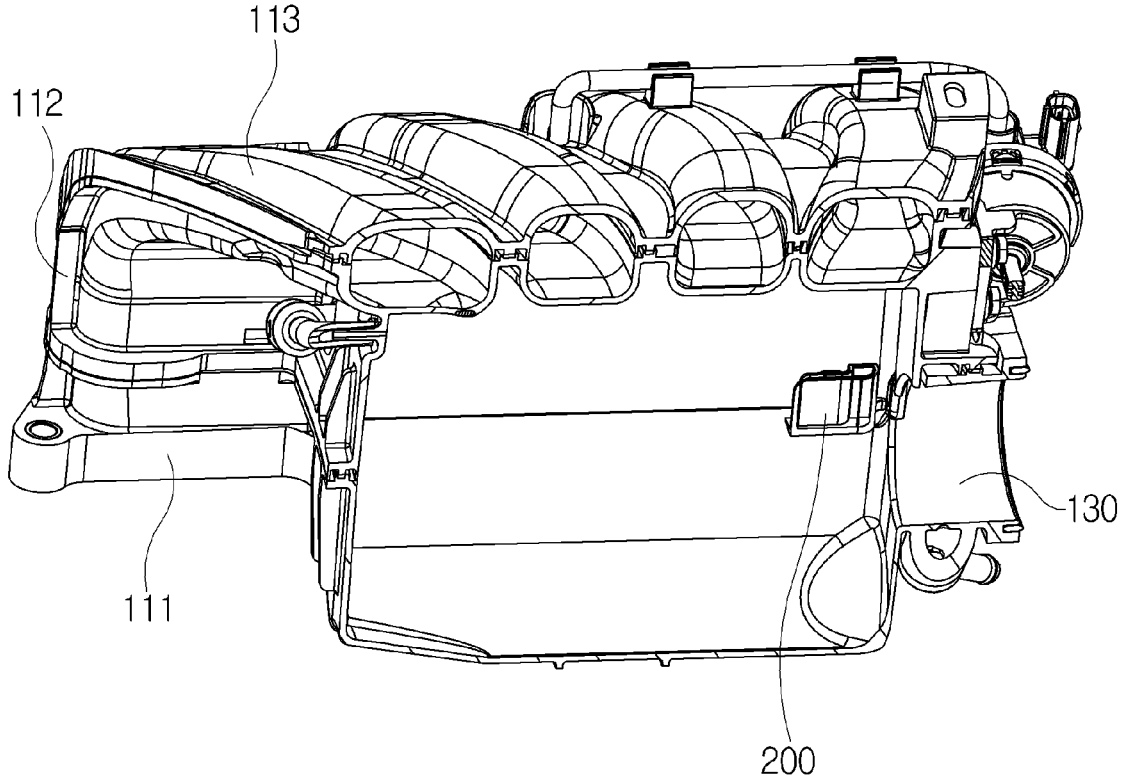
FIG. 3 is a perspective diagram cut along line A-A of FIG. 2.
Figure 4:
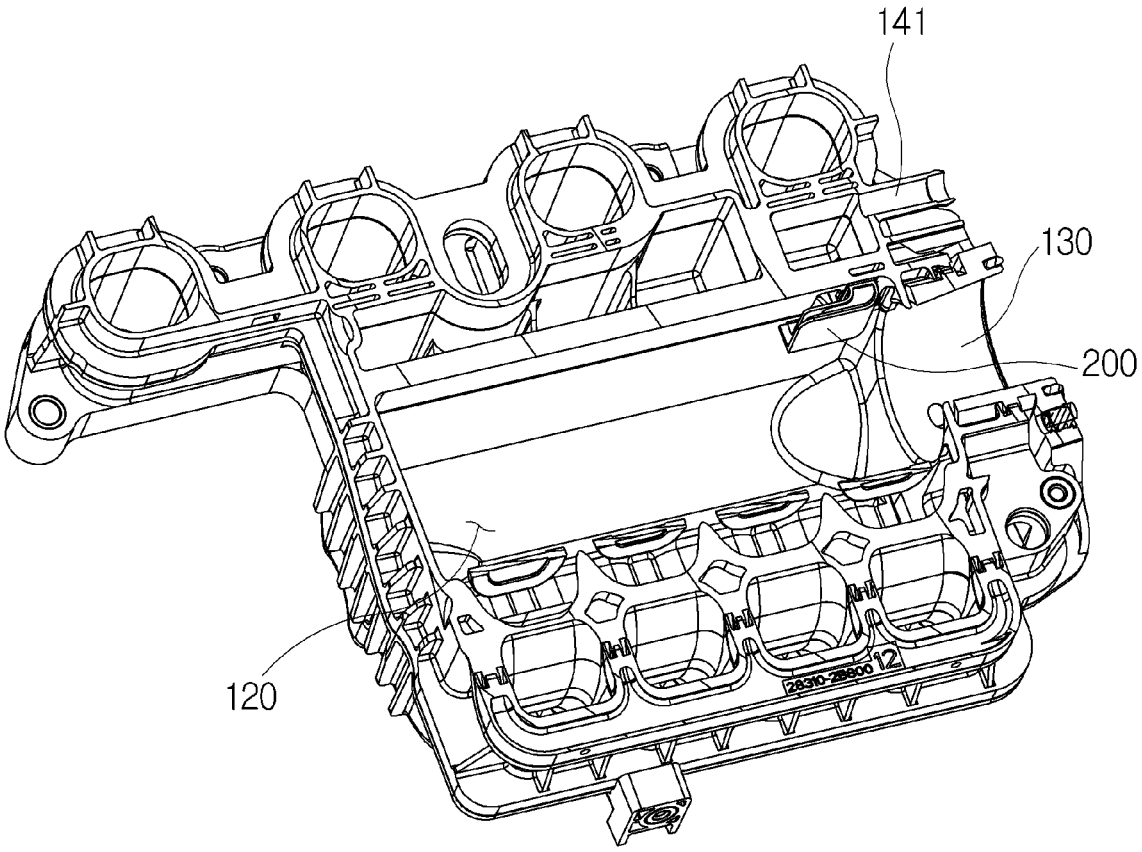
FIG. 4 is a lateral perspective diagram of FIG. 2.
Figure 5:
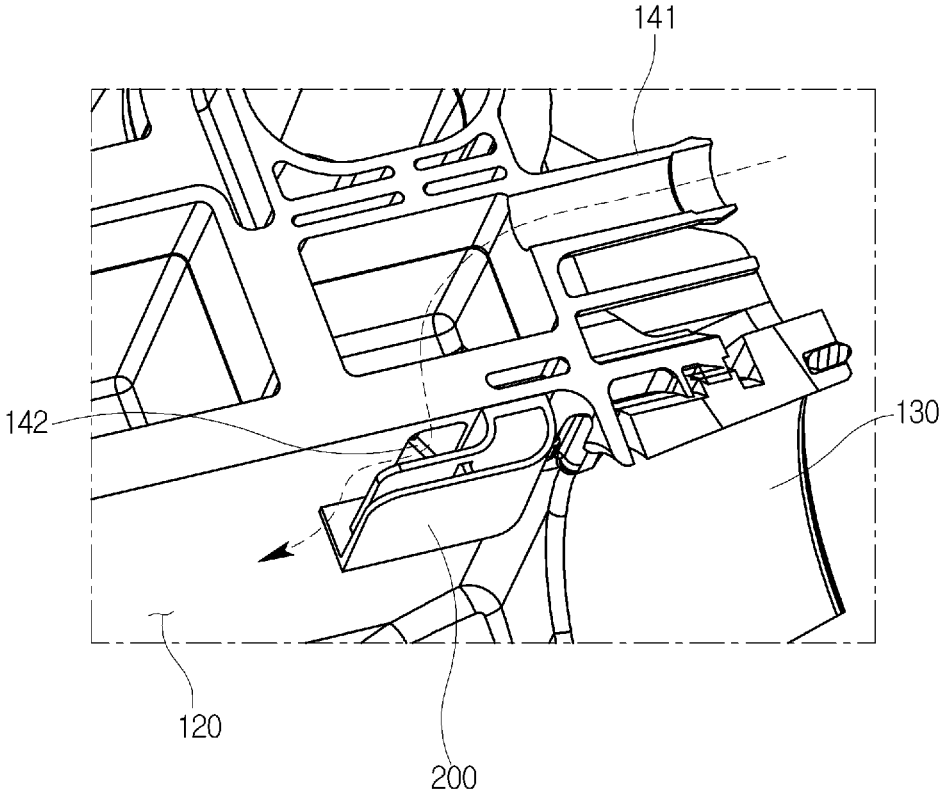
FIG. 5 is a partial enlarged diagram of FIG. 4.
Figure 8:
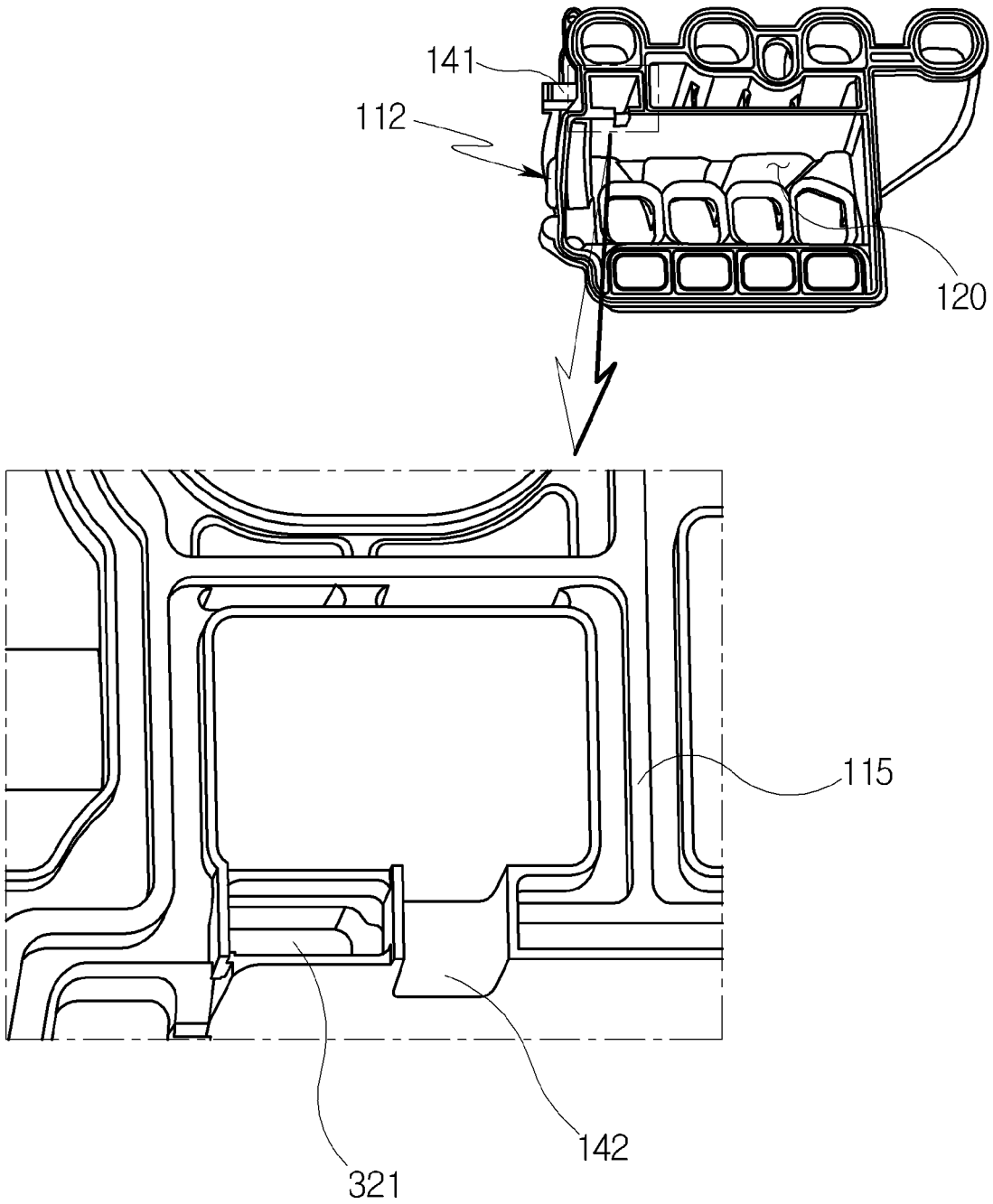
FIG. 8 is a perspective diagram illustrating a middle shell of the intake manifold illustrated in FIG. 2.
Figure 9:
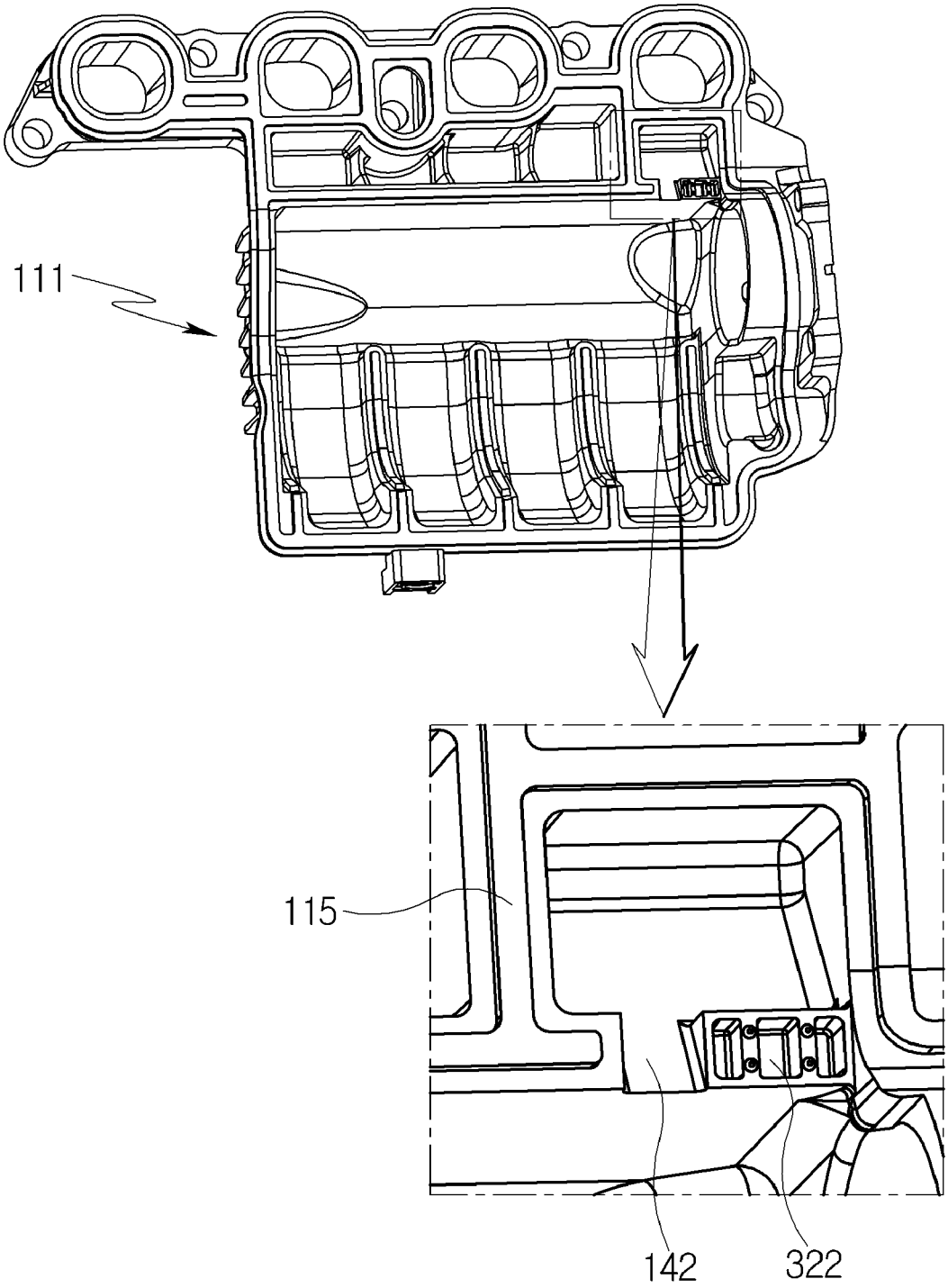
FIG. 9 is a perspective diagram illustrating a lower shell of the intake manifold illustrated in FIG. 2.
Figure 12:
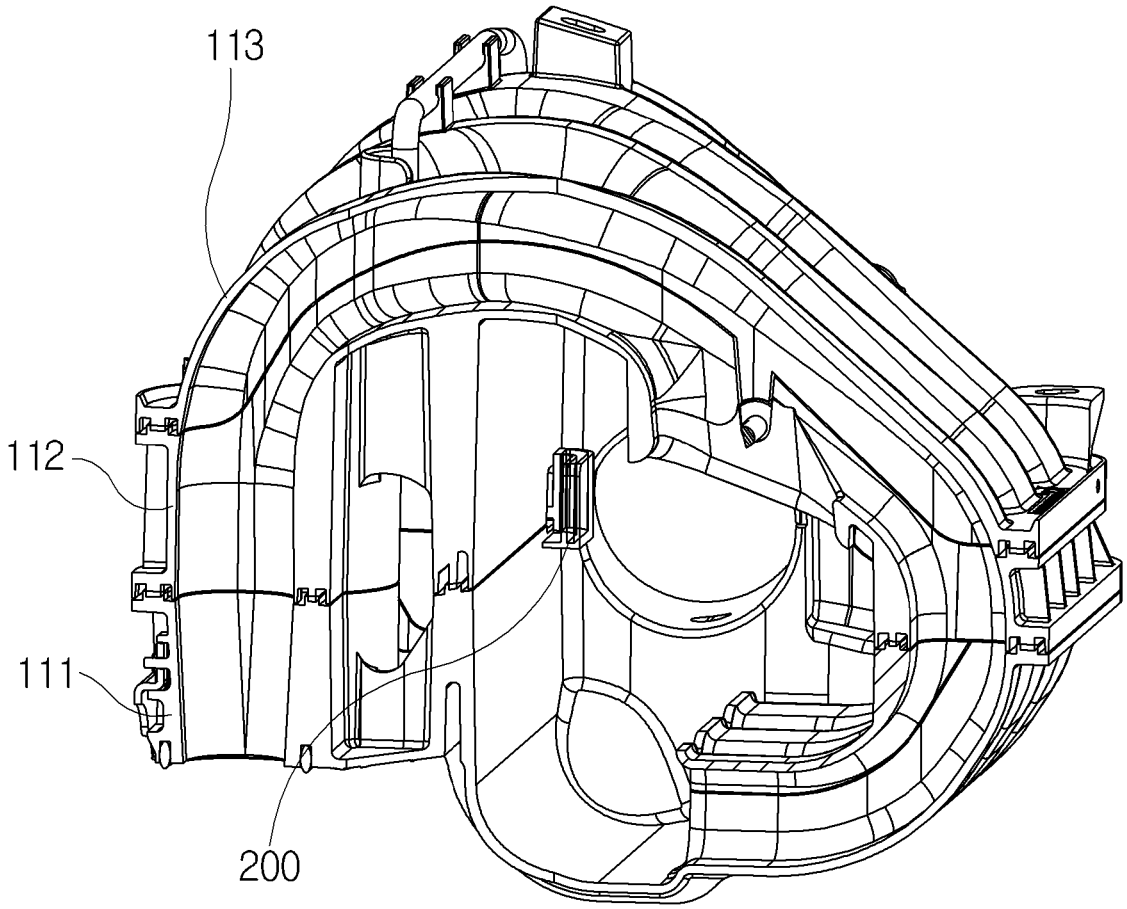

The intake manifold 100 may be assembled together following a formation of a plurality of shells, and the intake manifold 100 of the present exemplary embodiment may include three shells, including a lower shell 111, a middle shell 112, and an upper shell 113. The middle shell 112 is illustrated in FIG. 8, and the lower shell 111 is illustrated in FIG. 9. The two shells may have an engaging portion 115 that superposes (e.g. corresponds to) each other, respectively, and each engaging portion 115 may be formed along the edge of each shell and joined with the engaging portion 115 of another shell to couple the two shells. FIGS. 2, 3, and 12 illustrate the intake manifold 100 in which the lower shell 111, the middle shell 112, and the upper shell 113 are coupled.

The guide member 200 may include a guide 210 for directing the discharging direction of the blow-by gas discharged from the gas inlet 142 in a direction away from the fresh air inlet 130. The guide 210 may be formed to be bent in an elbow shape.

Meanwhile, the guide member 200 may further include a base plate 220 that is provided perpendicular to the side surface of the guide 210, to abut the inside wall of the plenum chamber 120, and is extended from the gas inlet 142 to block the blow-by gas flowing downward from the plenum chamber 120. The guide 210 may direct the discharging direction of the blow-by gas discharged from the gas inlet 142 to the direction away from the fresh air inlet 130. For example, the guide 210 formed in the elbow shape may divert the discharging direction of the blow-by gas discharged from the gas inlet 142 into the direction parallel to the inside wall of the plenum chamber 120, such that the blow-by gas may be moved to a more downstream location inside the plenum chamber 120 in the direction away from the fresh air inlet 130 and discharged.

Various embodiments of the guide 210 will be described with reference to FIGS. 6, 7, and 13 to 17.

First Exemplary Embodiment

Figure 6:
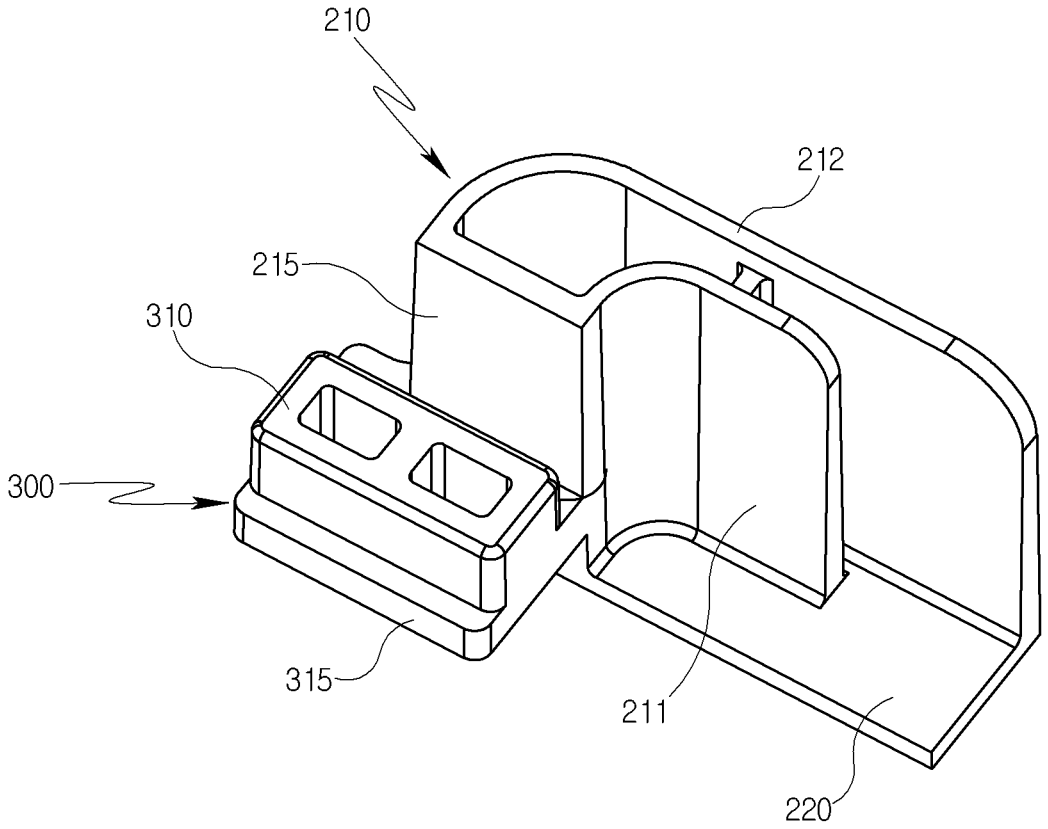
FIG. 6 is a perspective diagram illustrating a guide member illustrated in FIG. 5.
Figure 7:
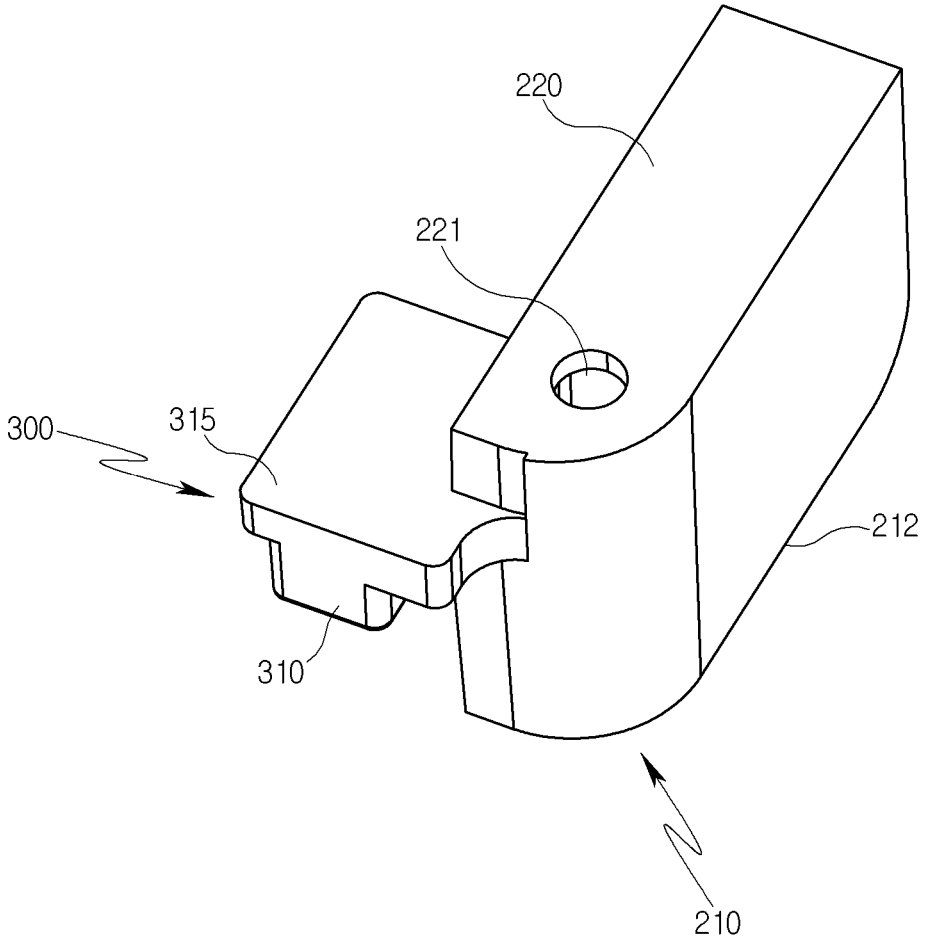
FIG. 7 is a bottom surface perspective diagram of the guide member illustrated in FIG. 6.

The guide 210 illustrated in FIGS. 6 and 7 may include a first guide 211 for diverting the discharging direction of the blow-by gas by obstructing the blow-by gas discharged from the gas inlet, and a second guide 212 spaced apart from the first guide 211 for blocking the stream of the fresh air that enters through the fresh air inlet 130 to prevent direct contact between the blow-by gas and the fresh air and for guiding the stream of the fresh air into the plenum chamber 120. In this case, the first guide 211 and the second guide 212 may be spaced apart from each other in tandem. The first guide 211 and the second guide 212 may be vertically formed on the base plate 220.

The fresh air supplied into the plenum chamber 120 through the fresh air inlet 130 may firstly contact the outer surface of the second guide 212 to block or delay the contact with the blow-by gas, and the first guide 211 may secondly prevent heat transfer and heat exchange through the second guide 212 in the separated structure.

The second guide 212 may be provided to be spaced apart from the inside wall of the plenum chamber 120 to the outside of the first guide 211 and may be formed to extend farther from the fresh air inlet 130 along a direction of the fresh air stream. In other words, the first guide 211 may be provided to be shorter than the second guide 212 so that the first guide 211 and the second guide 212 are stepped.

Due to this structure, the heat transfer with the fresh air may gradually increase toward a distal end of the second guide 212. That is, it may be effective to gradually increase the amount of heat contact toward the inside of the plenum chamber 120, rather than an abrupt contact between the blow-by gas and the fresh air, in order to reduce the condensation of moisture contents.

The first guide 211 and the second guide 212 may be formed of the same material as the intake manifold 100, but the heat transfer may still be blocked due to the double barrier structure.

A connection portion 215 may be formed on a proximal end portion of the first guide 211 and the second guide 212. The connection portion 215 may not only connect the first guide 211 and the second guide 212, but also support the engaging means 300 that will be described later.

In addition, the connection portion 215 may abut the inside wall of the plenum chamber 120 in a state where the middle shell 112 and the lower shell 111 of the intake manifold 100 that will be described later are engaged to support the guide member 200.

Second Exemplary Embodiment

Figure 13:
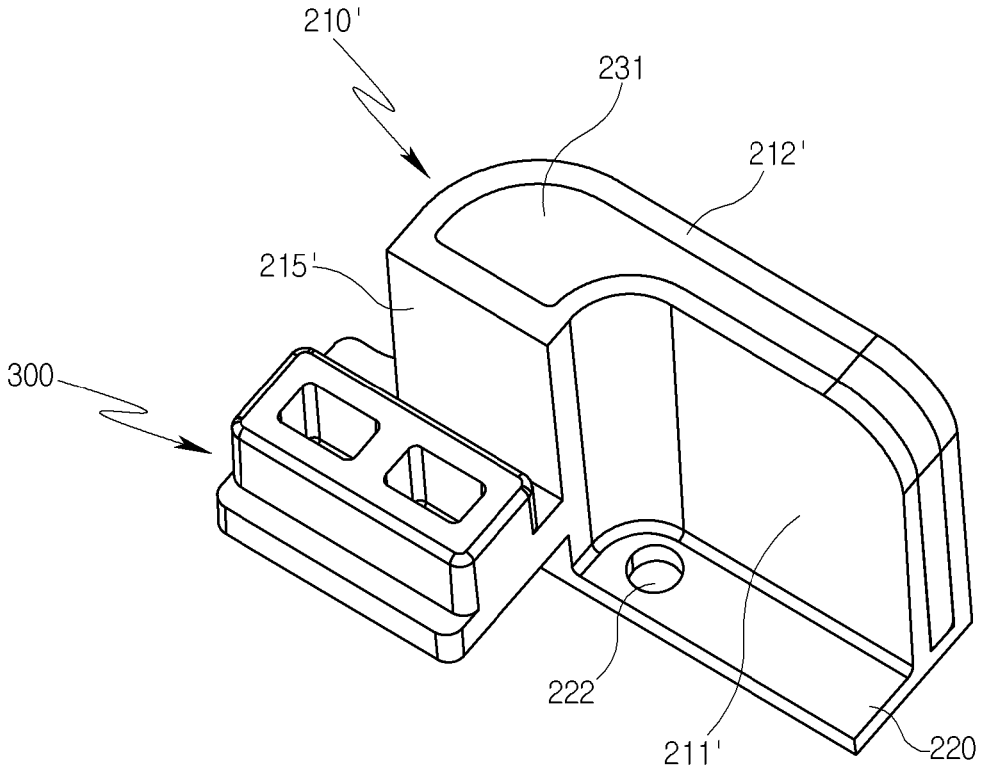
FIGS. 13 to 15 are perspective diagrams illustrating an anti-icing device of an intake manifold in accordance with another exemplary embodiment of the present disclosure.

A guide 210' illustrated in FIG. 13 may be filled with an insulating material 231 between a first guide 211' and a second guide 212'. For this structure, the distal ends of the first guide 211' and the second guide 212' may be extended equally.

The first guide 211' and the second guide 212' may be formed of the same material as the intake manifold 100 as in the first exemplary embodiment, but the insulating material 231 may be disposed between the first guide 211' and the second guide 212' to suppress the heat transfer from the first guide 211' to the second guide 212'.

Third Exemplary Embodiment

Figure 14:
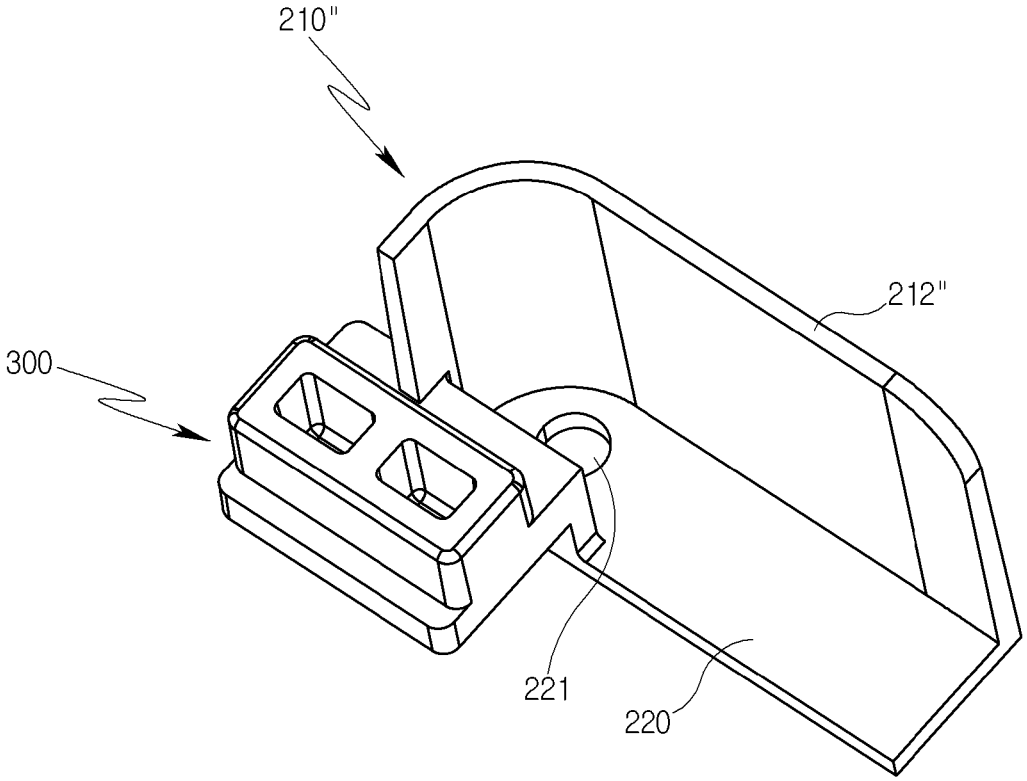

A guide 210" illustrated in FIG. 14 may include only the second guide 212".

The second guide 212" of the present exemplary embodiment may be formed of an insulating material. In particular, the second guide 212" may solely block the heat from the fresh air, and for this purpose, may be formed of an insulating material that is different from the intake manifold 100, thus performing the role of the insulating material 231 in the second exemplary embodiment.

Fourth Exemplary Embodiment

Figure 15:
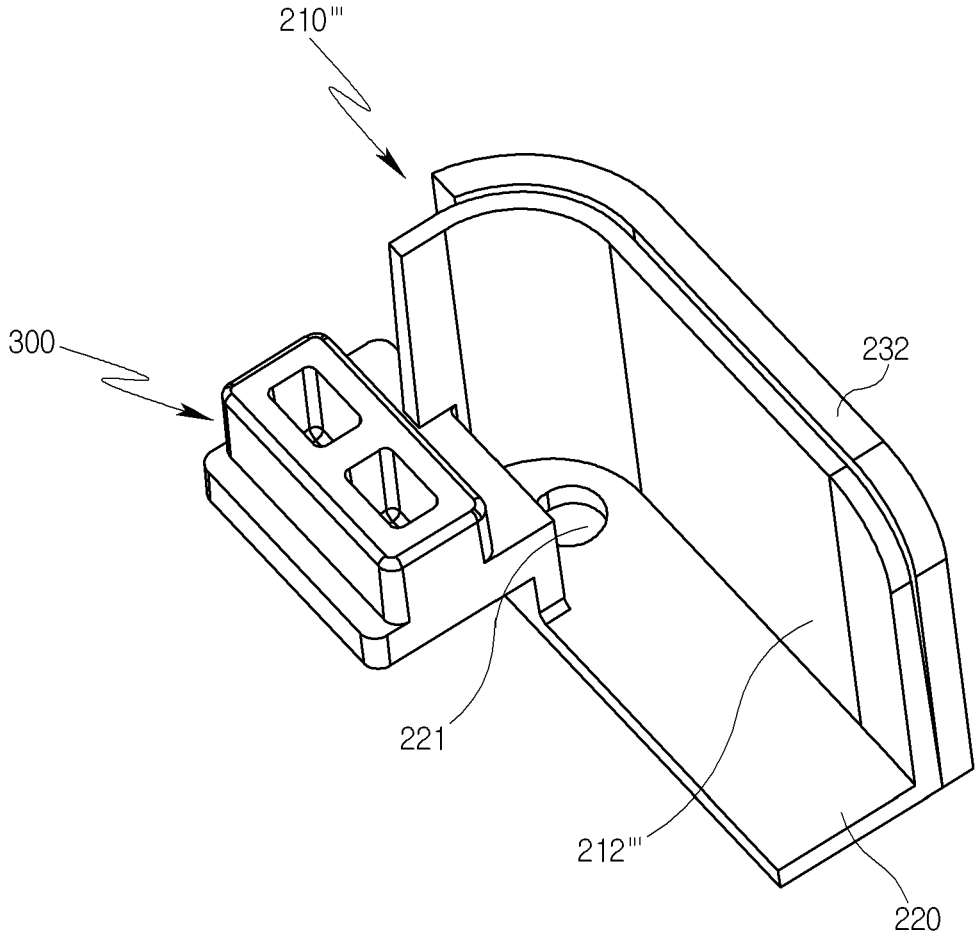

A guide 211'" illustrated in FIG. 15 may include the second guide 212'" as in the third exemplary embodiment, and an insulating material 232 may surround the outer surface of the second guide 212'".

The second guide 212'" of the present exemplary embodiment may be formed of the same material as the intake manifold 100, and the insulating material 232 for blocking the heat transfer may be disposed outside the second guide 212'".

Fifth Exemplary Embodiment

Figure 16:
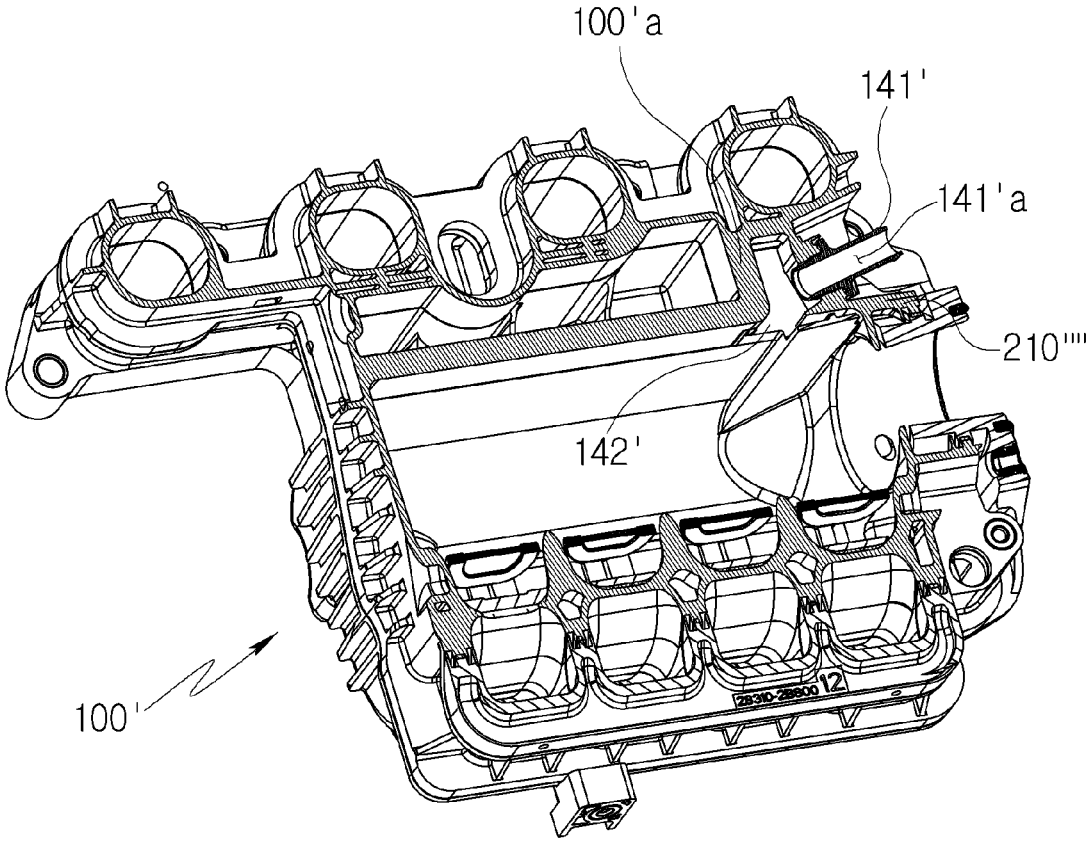
FIG. 16 is a lateral perspective diagram illustrating an anti-icing device of an intake manifold in accordance with yet another exemplary embodiment of the present disclosure.
Figure 17:
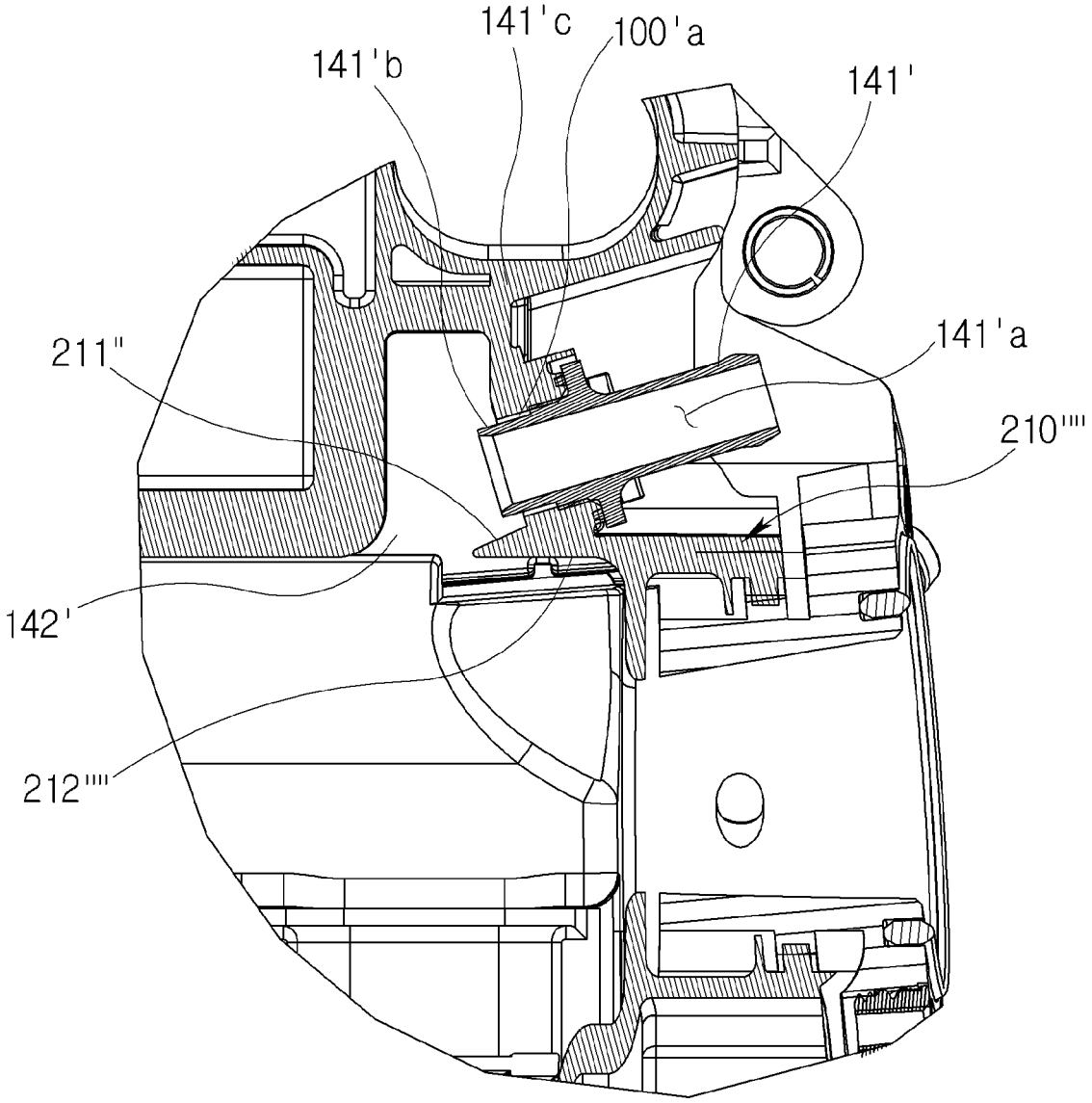
FIG. 17 is a partial enlarged diagram of FIG. 16.

In a guide 210"" illustrated in FIGS. 16 and 17, the first guide 211" and the second guide 212"" may be integrally formed with the shell 100'*a* of an intake manifold 100'. For example, when three of the upper shell, the middle shell, and the lower shell are configured, two or more shells may be integrally formed, respectively, and may be also configured in a detachable manner when the shells are assembled; and thereby it is not limited to a specific shell.

The roles of the first guide 211" and the second guide 212"" may be substantially the same as those of the first guide 211 and the second guide 212 in the first exemplary embodiment.

Under such a structure, a PCV nipple 141' may be formed separately and mounted on the intake manifold 100' and when mounted on the intake manifold 100', may have an inclined gas flow path 141'*a* toward a gas inlet 142'; and a protrusion 141'*b* may be formed on the outer circumferential surface of the end portion of the gas inlet 142' side.

Particularly, the protrusion 141'*b* may form a heat conduction barrier space 141'*c* between the shell 100'*a* and the PCV nipple 141', such that the low temperature of the fresh air conveyed through the second guide 212"" and the first guide 211" may be prevented from being directly conducted to the end portion of the PCV nipple 141', thus preventing the moisture of the blow-by gas from freezing.

Hereinafter, the remaining configurations will be described in detail with reference to the first to fourth exemplary embodiments.

The base plate 220 may be provided substantially perpendicular to a side surface of the guide 210, and may be provided in contact with the inside wall of the plenum chamber 120. The base plate 220 may be provided only on one side surface of both side surfaces of the guide 210. Accordingly, the guide member 200 may be blocked by the base plate 220 only on one side of the guide 210, and the opposite side thereof may be formed to be open.

Herein, as illustrated in FIG. 12, the intake manifold 100 may be disposed so that the upper shell 113 may be disposed above the middle shell 112 and the lower shell 111 may be disposed below the middle shell 112 with respect to the gravity direction upon mounting an engine, and the guide member 200 may be coupled to the intake manifold 100 so that a portion on which the base plate 220 is provided may be disposed below the opening thereof.

Accordingly, when the moisture is condensed due to the contact between the blow-by gas discharged from the gas inlet 142 and the fresh air, the condensed water may precipitate onto the base plate 220 by gravity and may be collected.

Drain apertures 221, 222 may be formed in the base plate 220 and may discharge the condensed water in order not to freeze the condensed water. Since the blow-by gas may contact with the fresh air at the location that is away from the gas inlet 142 by the guide 210, condensation or freezing of water near the gas inlet 142 may be reduced, but the condensed water generated may also drop on the bottom of the plenum chamber 120 through the drain apertures 221, 222.

Meanwhile, the fresh air may flow into the guide member 200 through the opening at the opposite side of the base plate 220, thereby allowing a gradual interaction between the fresh air and the blow-by gas to reduce the temperature difference. As illustrated in FIGS. 3 and 12, the guide member 200 may be disposed at the central left side of the cylindrical shape of the fresh air inlet 130. Accordingly, the opening at the opposite side of the base plate 220 may be disposed above the center of the fresh air inlet 130, thereby reducing the amount of fresh air flowing through the opening compared to when the opening is disposed on the center of the fresh air inlet 130, and a small amount of the incoming fresh air may gradually contact the blow-by gas, thus reducing the freezing due to the abrupt temperature difference.

The locations of the drain apertures 221, 222 in the base plate 220 may vary based on the shape and location of the guide 210. For example, in the first exemplary embodiment illustrated in FIG. 6, the drain aperture 221 may be interposed between the first guide 211 and the second guide 212, and in the second exemplary embodiment illustrated in FIG. 13, the drain aperture 222 may be formed inside the first guide 211. In the third exemplary embodiment illustrated in FIG. 14 and the fourth exemplary embodiment illustrated in FIG. 15, the location of the drain aperture 221 on the base plate 220 may be formed as in the first exemplary embodiment.

As in the first exemplary embodiment of FIG. 6, when the drain aperture 221 is interposed between the first guide 211 and the second guide 212, the fresh air flowing from the space between the first guide 211 and the second guide 212 through the second guide 212 may contact with the blow-by gas, and the condensed water that may be generated may be discharged to the drain aperture 221. In the second exemplary embodiment of FIG. 13, the insulating material 232 may be filled between the first guide 211 and the second guide 212 and thereby the drain aperture 222 may be formed inside the first guide 211.

The guide member 200 may be provided inside the plenum chamber 120 by the engaging means 300. The engaging means 300 may include an engaging boss portion 310 fitted and engaged into a boss receiving portion 321, and the boss receiving portion 321 receiving the engaging boss portion 310.

The engaging boss portion 310 may be integrally formed by injection-molding with the guide member 200. As illustrated the first exemplary embodiment of FIG. 6, an engaging bracket 315 may be formed to be protruded from the end portions of the first guide 211 and the second guide 212 and the connection portion 215, and the engaging boss portion 310 may be formed to be protruded from the engaging bracket 315.

The engaging bracket 315 may be formed in a plate shape parallel to the base plate 220, and the engaging boss portion 310 may be formed to be protruded upward from the base plate 220.

The boss receiving portion 321 may be provided in the intake manifold 100. That is, as illustrated in FIGS. 8 to 11, the boss receiving portion 321 may be provided in the engaging portion 115 where the lower shell 111 and the middle shell 112 of the intake manifold 100 may be superposed with each other. The boss receiving portion 321 may be formed in the middle shell 112, and the lower shell 111 may be formed with a lower receiving portion 322 for receiving the engaging bracket 315. As illustrated in FIG. 9, the lower receiving portion 322 may be formed to be more depressed than the engaging portion 115 of the lower shell 111, such that the engaging bracket 315 may be seated in the lower receiving portion 322 when the engaging boss portion 310 is fitted and engaged in the boss receiving portion 321.

Figure 10:
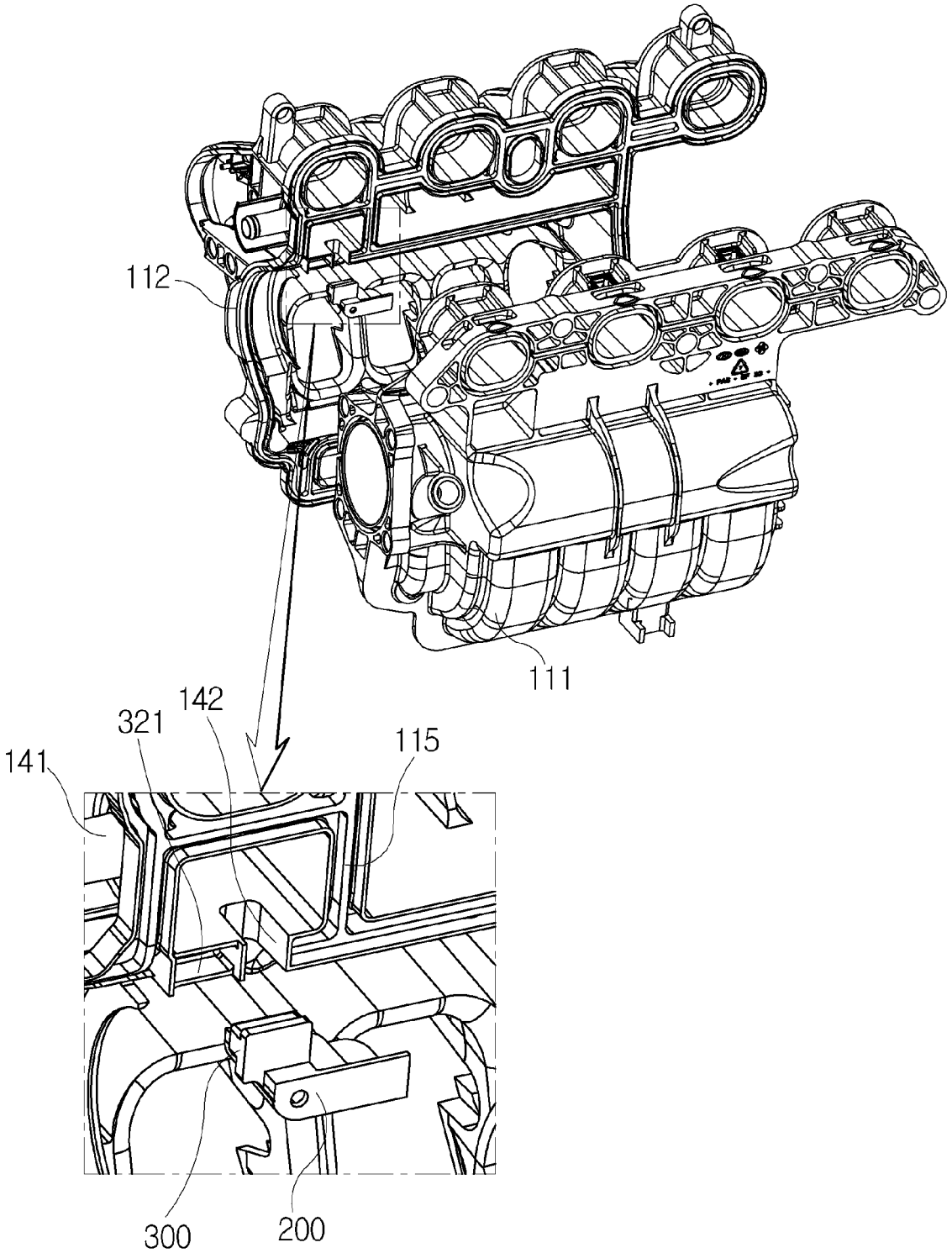
FIGS. 10 to 12 are perspective diagrams illustrating the engaged state of the middle shell and the lower shell and the guide member illustrated in FIGS. 8 and 9.
Figure 11:
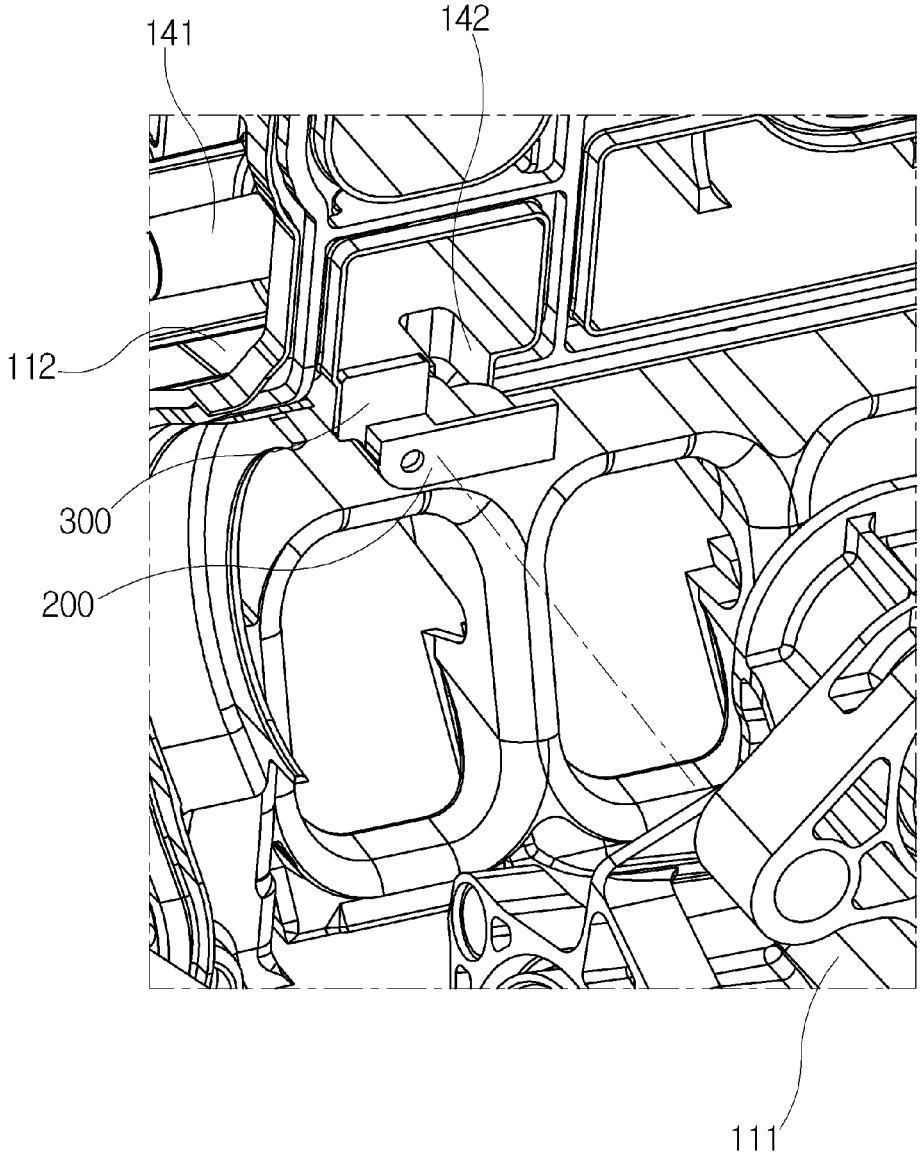

Referring to FIGS. 10 to 11, the lower shell 111 and the middle shell 112 may be superposed and assembled in a state where the engaging boss portion 310 is fitted in the boss receiving portion 321. The engaging boss portion 310 may be fitted in the boss receiving portion 321 in a direction in which the lower shell 111 and the middle shell 112 are superposed with each other. In other words, the engaging boss portion 310 may be fitted in the boss receiving portion 321 in a direction in which the lower shell 111 and the middle shell 112 are coupled.

As illustrated in FIG. 11, the lower shell 111 is coupled into the middle shell 112 in a state where the engaging boss portion 310 is first fitted in the boss receiving portion 321, and subsequently, the engaging bracket 315 may also be seated in the lower receiving portion 322 formed in the middle shell 112.

As described above, when the middle shell 112 and the lower shell 111 are coupled in a state where the engaging boss portion 310 is fitted and engaged in the boss receiving portion 321, the guide member 200 may be engaged without being detached in the inside direction of the plenum chamber 120 unless the middle shell 112 and the lower shell 111 are separated from each other.

As described above, while the present disclosure has been described in detail with respect to the specific exemplary embodiments, it will be apparent to those skilled in the art that it is for explaining the present disclosure in detail and the present disclosure is not limited thereto, and various variations or improvements of the present disclosure can be made within the technical spirit of the disclosure.

All of variations or changes of the present disclosure belong to the scope of the present disclosure, and the detailed scope of the present disclosure will be apparent by the appended claims.

What is claimed is:

1. An anti-icing device for an intake manifold to prevent moisture from freezing in a blow-by gas that flows from a crankcase of an engine into a plenum chamber of the intake manifold through a gas inlet via a Positive Crankcase Ventilation (PCV) nipple due to a temperature difference with a fresh air supplied into the plenum chamber through a fresh air inlet, the anti-icing device comprising:

a guide member disposed within the plenum chamber, and for inducing the blow-by gas discharged from the gas inlet toward inside of the plenum chamber in a direction that is away from the fresh air inlet in order to retard a contact with the fresh air; and an engaging member for fixing the guide member to the intake manifold, wherein the engaging member comprises:

an engaging boss portion integrally injection-molded with the guide member; and a boss receiving portion provided in the intake manifold, wherein the engaging boss portion is configured to be coupled to the boss receiving portion.

2. The anti-icing device for the intake manifold of claim 1, wherein the guide member comprises a guide for inducing a discharging direction of the blow-by gas discharged from the gas inlet to the direction that is away from the fresh air inlet.

3. The anti-icing device for the intake manifold of claim 2, wherein a thermal insulating material is disposed on the guide on an outer side thereof that is opposite of an inner side that faces the discharged blow-by gas.

4. The anti-icing device for the intake manifold of claim 2, wherein the guide comprises:

a first guide panel for diverting the discharging direction of the blow-by gas discharged from the gas inlet; and a second guide panel spaced apart from the first guide panel, and for guiding an inflow of the fresh air to the plenum chamber to obstruct a stream of the fresh air through the fresh air inlet from contacting the blow-by gas.

5. The anti-icing device for the intake manifold of claim 4, wherein the second guide panel is spaced apart from the first guide panel to an outer side that is opposite of an inner side that faces the discharged blow-by gas, and formed to extend farther from the fresh air inlet than the first guide panel.

6. The anti-icing device for the intake manifold of claim 4, wherein a thermal insulating material is disposed between the first guide panel and the second guide panel.

7. The anti-icing device for the intake manifold of claim 2, wherein the guide member further comprises a base plate formed substantially perpendicular to the guide and formed to abut an inside wall of the plenum chamber.

8. The anti-icing device for the intake manifold of claim 7, wherein the guide member has an open side on an opposite side of the base plate.

9. The anti-icing device for the intake manifold of claim 7, wherein a drain aperture is formed on the base plate.

10. The anti-icing device for the intake manifold of claim 1, wherein the boss receiving portion is provided in an engaging portion in which a lower shell and a middle shell of the intake manifold is configured to be superposed with each other, and wherein the lower shell and the middle shell are superposed and assembled with the engaging boss portion fitted in the boss receiving portion.

11. The anti-icing device for the intake manifold of claim 10, wherein the engaging boss portion is fitted in the boss receiving portion in a direction in which the lower shell and the middle shell are coupled.

12. The anti-icing device for the intake manifold of claim 4, wherein the first guide panel and the second guide panel are integrally molded and formed with shells of the intake manifold.

13. The anti-icing device for the intake manifold of claim 12, wherein the PCV nipple is formed separately and coupled on the intake manifold to have an inclined gas flow path toward the gas inlet, and a protrusion is formed on an outer circumferential surface of an end portion thereof toward the gas inlet.

* * * * *